US005144096A

United States Patent [19]

Kunimoto

[11] Patent Number: 5,144,096

[45] Date of Patent: Sep. 1, 1992

[54] NONLINEAR FUNCTION GENERATION APPARATUS, AND MUSICAL TONE SYNTHESIS APPARATUS UTILIZING THE SAME

[75] Inventor: Toshifumi Kunimoto, Hamamatsu, Japan

[73] Assignee: Yamaha Corporation, Hamamatsu, Japan

[21] Appl. No.: 613,163

[22] Filed: Nov. 13, 1990

[30] Foreign Application Priority Data

Nov. 13, 1989 [JP] Japan ..... 1-292257
Nov. 22, 1989 [JP] Japan ..... 1-301950

[51] Int. Cl.[5] ..... G10H 1/14

[52] U.S. Cl. ..... 84/659; 84/707; 84/630; 84/DIG. 10; 84/DIG. 26

[58] Field of Search ..... 84/DIG. 10, DIG. 26, 84/630, 707, 659

[56] References Cited

U.S. PATENT DOCUMENTS 3,838,202 9/1974 Nakada ..... 84/693
4,249,447 2/1981 Tomisawa ..... 84/605
4,542,525 9/1985 Hopf ..... 381/56
4,655,115 4/1987 Nishimoto ..... 84/DIG. 10
4,757,737 7/1988 Conti ..... 84/681
4,984,276 1/1991 Smith ..... 84/630 X

FOREIGN PATENT DOCUMENTS 63-40199 2/1988 Japan .
64-73394 3/1989 Japan .

*Primary Examiner*—William M. Shoop, Jr.
*Assistant Examiner*—Brian Sircus
*Attorney, Agent, or Firm*—Graham & James

[57] ABSTRACT

A nonlinear function generation apparatus and a musical tone synthesis apparatus are disclosed.

The nonlinear function generation apparatus comprises hysteresis and nonhysteresis function generators for generating hysteresis and nonhysteresis functions using an input signal as a variable respectively, and a multiplier for synthesizing the functions outputted from the generators.

The musical tone synthesis apparatus comprises a closed loop including delay circuits, and the nonlinear function generation apparatus.

6 Claims, 6 Drawing Sheets

NONLINEAR FUNCTION GENERATION APPARATUS, AND MUSICAL TONE SYNTHESIS APPARATUS UTILIZING THE SAME

BACKGROUND OF THE INVENTION

1. Field of the Invention

The present invention relates to a nonlinear function generation apparatus for generating a nonlinear function having hysteresis characteristics and a musical tone synthesis apparatus utilizing the same and, more particularly, to a musical tone synthesis apparatus using a so-called delayed feedback type decay tone algorithm used in, e.g., an electronic musical instrument and a nonlinear function generation apparatus suitable therefor.

2. Description of the Prior Art

Conventionally, as a so-called digital sound source used in, e.g., an electronic musical instrument, a musical tone synthesis apparatus using a so-called delayed feedback type decay tone synthesis algorithm for synthesizing musical tones by introducing data such as initial waveform data, impulse signal data, nonlinear signal data, and the like into a closed loop including a delay circuit, and performing feedback arithmetic processing of the introduced data is known (e.g., Japanese Patent Laid-open Sho. No. 63-40199).

The musical tone synthesis apparatus physically approximates a mechanical vibration system of an acoustic musical instrument such as a pipe of a wind instrument, strings of a stringed instrument, or the like by an electrical circuit. The apparatus receives a nonlinear signal corresponding to a reed or embouchure (mouthpiece) of a wind instrument or a movement of a contact between a bow and a string of a bowed instrument, thereby naturally and faithfully synthesizing a tone of the wind instrument or the bowed instrument as well as a change in tone magnitude.

FIG. 10 shows the relationship between an external force F given to a string by a bow of a bowed instrument, and a displacement velocity V given to the string by the external force F. When the external force F is near zero, since contribution of a static friction is dominant, the displacement velocity V is proportional to the external force F. When a given external force or more is applied, a dynamic friction becomes dominant, and the displacement velocity V is rendered constant or is inverse proportional to the external force F. Upon transition from the static friction to the dynamic friction, since a degree of contribution of the external force F to the displacement velocity V of a string is abruptly changed, external force F vs. displacement velocity V characteristics are represented by a nonlinear curve, as shown in FIG. 10. When the external force F is decreased, the displacement velocity V changes nonlinearly upon transition from the dynamic friction to the static friction. In this manner, in a synthesis algorithm of a bowed instrument, a nonlinear signal having a hysteresis characteristic shown in FIG. 10 is required. It is preferable to finely control this nonlinear signal according to a bow pressure or a bow velocity.

The present inventor has previously proposed, as a signal source of such a nonlinear signal having a hysteresis, a system wherein a characteristic function based on the static friction and that based on the dynamic friction are switched according to an input value of, e.g., an external force, and a threshold level for switching the functions is shifted according to a change direction of the input value (Japanese Patent Application Hei. No. 1-192708: U.S. Pat. application Ser. No. 07/557,963). However, hardware or software for realizing this system is complicated.

The present inventor has also previously proposed a system wherein a nonlinear signal generation apparatus is inserted in a feedback loop to provide a hysteresis to an output signal (Japanese Patent Application Hei. No. 1-194544: U.S. Pat. application Ser. No. 07/557,963). This system suffers from another demerit although it has a simple arrangement.

FIG. 11 shows a nonlinear signal generation apparatus for a bowed string algorithm which generates a hysteresis by a feedback loop. In FIG. 11, a nonlinear table 71 generates a nonlinear function, as shown in FIG. 12. This nonlinear function is defined by an almost straight line portion having a negative inclination $\alpha$ near an origin, and curve portions having a positive inclination at two ends of the straight line portion. A feedback circuit 72 shown in FIG. 11 has a positive gain $\beta$.

An I/O transfer function of such a nonlinear system will be examined below in units of portions having positive and negative inclinations of the nonlinear functions, respectively. In a portion having the positive inclination, a hysteresis is generated by the positive feedback gain $\beta$. In a portion having the negative inclination $\alpha$, since a feedback loop serves as a negative feedback (NFB) loop, a total gain (transfer function) $G_{NFB}$ is given by:

$$G_{NFB} = \frac{\alpha}{1 - \alpha\beta}$$

In the bowed string algorithm, since the gain of the straight line portion of the nonlinear function must be a constant (normally, about $-1$ or $-2$), if $G_{NFB}$ given by the above equation is represented by, e.g., $-1$, we have:

$$\alpha = \frac{1}{\beta - 1}$$

In consideration of stability of the system under the condition in that $\alpha$ is positive and $\beta$ is negative, if a loop gain $\alpha\beta$ is too large, the NFB system often causes a parasitic oscillation. As a result, $\alpha$ is settled to be about $-1.1$, and $\beta$ is settled to be about 0.09. However, when a positive feedback (PFB) system is constituted by portions having positive $\alpha$ at two ends of the straight portion of the nonlinear function, the above-mentioned feedback amount cannot provide a sufficient PFB amount, and a hysteresis cannot be satisfactorily generated. In other words, with the arrangement shown in FIG. 11, a feedback amount of the PFB system must be increased to obtain a sufficient hysteresis, and must be decreased to attain stable NFB. However, it is almost impossible to attain both generation of a sufficient hysteresis and stability of the system.

SUMMARY OF THE INVENTION

The present invention has been made in consideration of conventional problems, and has as its object to provide a nonlinear function generation apparatus which can generate a sufficient hysteresis with a simple arrangement, and can be stably operated, and a musical tone synthesis apparatus utilizing the same.

In order to achieve the above object, according to a first aspect of the present invention, a nonlinear function generation apparatus comprises hysteresis function generation means for generating a hysteresis function using an input signal as a variable, nonhysteresis function generation means for generating a nonhysteresis function using the input signal as a variable, and synthesis arithmetic means for synthesizing the functions outputted from these hysteresis and nonhysteresis function generation means.

The hysteresis function generation means comprises basic nonlinear function generation means for generating a nonhysteresis basic nonlinear function, and feedback means for positively feeding back an output from the basic nonlinear function generation means to an input side of the basic nonlinear function generation means to be with the input signal, and supplying the synthesized output to the basic nonlinear function generation means as a variable.

The basic nonlinear function may be a step function.

According to the above arrangement, the nonlinear function is decomposed into a hysteresis function component, and a nonhysteresis function component. These function components are respectively outputted from the hysteresis and nonhysteresis function generation means using an input signal as a variable, and are then synthesized by the synthesis arithmetic means such as a multiplier.

For example, the hysteresis function generation means comprises a PFB circuit including the basic nonlinear function generation means for generating a nonhysteresis basic nonlinear function (such as a step function), and provides a hysteresis to the basic nonlinear function outputted from this basic nonlinear function generation means.

In this manner, according to the present invention, hysteresis and nonhysteresis functions are separately generated, and are then synthesized to obtain a nonlinear function, resulting in a simple arrangement.

When a means for giving a hysteresis by a feedback system is used as the hysteresis function generation means, the hysteresis function generation means need only generate a hysteresis function component. Therefore, an original nonhysteresis function can be set to have no negative inclination or a very small positive inclination. Therefore, a feedback system of this hysteresis function generation means is substantially constituted by only a PFB system, and instability caused by an NFB system can be eliminated. For this reason, a large feedback gain concerning only a hysteresis can be set.

According to a second aspect of the present invention, a nonlinear function generation apparatus comprises a plurality of hysteresis function generation means for generating different hysteresis functions using an input signal as a variable, and synthesis arithmetic means for synthesizing the functions outputted from the hysteresis function generation means.

With the above arrangement, a nonlinear function having a hysteresis is decomposed into a plurality of hysteresis function components, and these components are outputted from the plurality of hysteresis function generation means. These output components are then synthesized by the synthesis arithmetic means such as a multiplier.

Since the apparatus of the second aspect generates a hysteresis function as a plurality of components, a width or step of a hysteresis function can be arbitrarily set in units of components, resulting in a high degree of margin of a hysteresis pattern.

The nonlinear function generation apparatus of the second aspect can be effectively applied as the hysteresis function generation means of the first aspect.

According to a third aspect of the present invention, in a musical tone synthesis apparatus which includes closed loop means including delay means, and nonlinear function generation means for generating a nonlinear signal using a performance operation signal and a signal extracted from the closed loop means as variables, and supplying it to the closed loop means, a nonlinear function generation apparatus according to the first or second aspect is used as the nonlinear function generation means.

According to the third aspect, by utilizing the above-mentioned nonlinear function generation apparatus, a musical tone synthesis apparatus which can generate a musical tone closer to that of an acoustic musical instrument with a simple arrangement can be provided.

DETAILED DESCRIPTION OF THE PREFERRED EMBODIMENTS

The preferred embodiments of the present invention will be described in detail hereinafter.

First Embodiment

Figure 1:
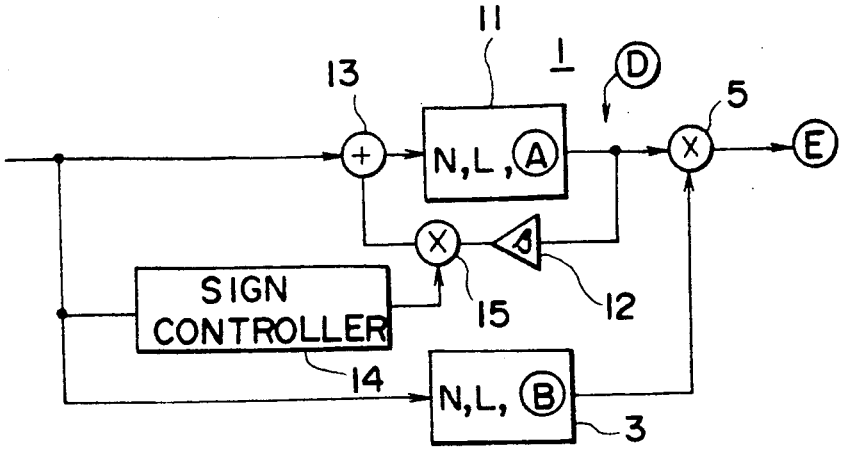
FIG. 1 is a block diagram showing an arrangement of a nonlinear function generation apparatus according to the first embodiment of the present invention.

FIG. 1 shows an arrangement of a nonlinear function generation apparatus according to an embodiment of the present invention.

Figure 2A:
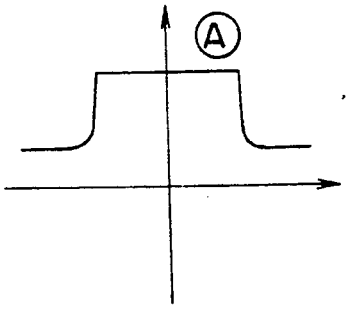
FIGS. 2A to 2C and FIGS. 3A and 3B are graphs showing nonlinear functions for explaining the operation principle of the apparatus shown in FIG. 1.
Figure 2B:
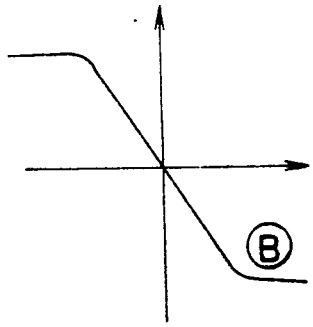
Figure 2C:
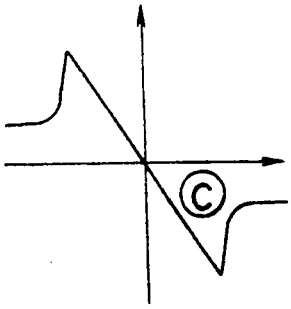
Figure 3A:
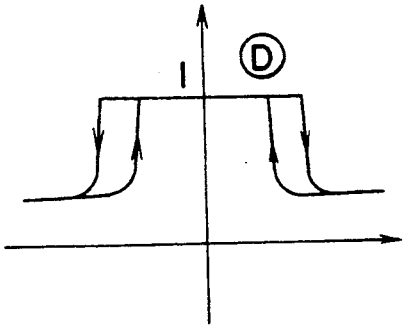

The apparatus shown in FIG. 1 decomposes a nonlinear function C shown in FIG. 2C into a product of nonlinear function generator 11 of which input-output characteristic shows nonlinear function A as shown in FIG. 2A and a nonlinear function generator 3 of which input-output characteristic shows nonlinear function B as shown in FIG. 2B. The apparatus gives a hysteresis to the nonlinear function A by a feedback method to obtain hysteresis characteristic between an input and output, i.e. X, and Y, such as a hysteresis function D as shown in FIG. 3A, and multiplies this function D with the nonlinear function B to generate a nonlinear characteristic between an input $X_2$ and output $Y_2$ such as a nonlinear function E having a hysteresis shown in FIG. 3B. Thus, the apparatus comprises a hysteresis function generator 1 for generating the hysteresis function D, a nonhysteresis function generator 3 for generating the nonlinear function B, and a multiplier 5 for multiplying the functions D and B.

The hysteresis function generator 1 comprises a step function generator 11 for generating the nonlinear function (step function) A expressed by a trapezoidal curve shown in FIG. 2A, a feedback circuit 12 for feeding back the output from the step function generator 11 to the input side, and an adder 13. The step function A has a positive inclination in a negative input region, and has a negative inclination in a positive input region. Therefore, if a feedback constant $\beta$ of the feedback circuit 12 is assumed to be a positive value, a negative feedback system is undesirably constituted in a positive input region, and a desired hysteresis cannot be obtained. Thus, control must be made so that the feedback system always becomes a positive feedback system. In order to achieve this, a sign of $\beta$ is preferably inverted depending on a positive or negative input and nonlinear characteristics. A $\beta$ sign controller 14 and a multiplier 15 in the hysteresis function generator 1 shown in FIG. 1 are used to control so that $\beta$ has an opposite sign to an input sign.

Figure 4A:
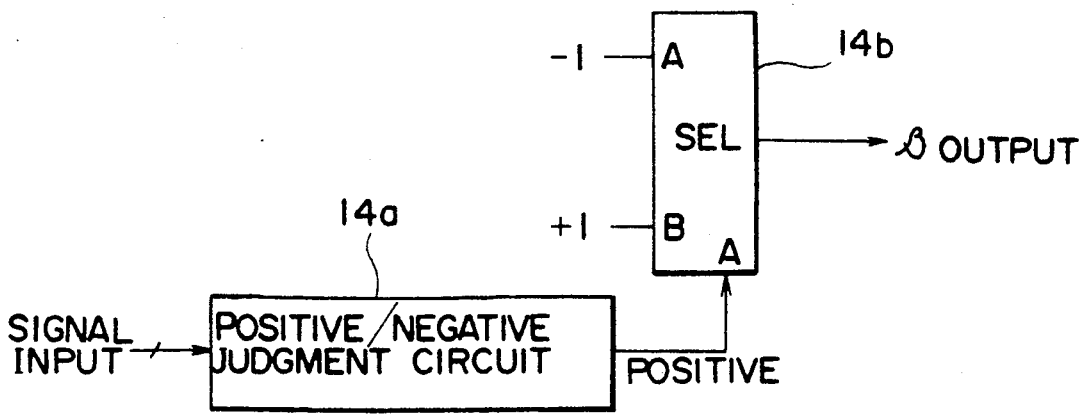
FIGS. 4A to 4C are block diagrams showing detailed circuit arrangements of a sign controller shown in FIG. 1.
Figure 4B:
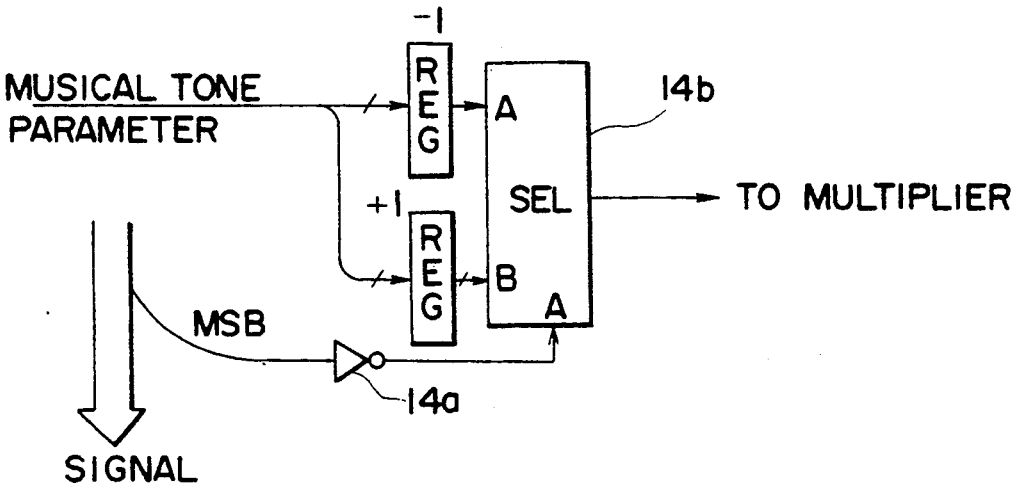
Figure 4C:
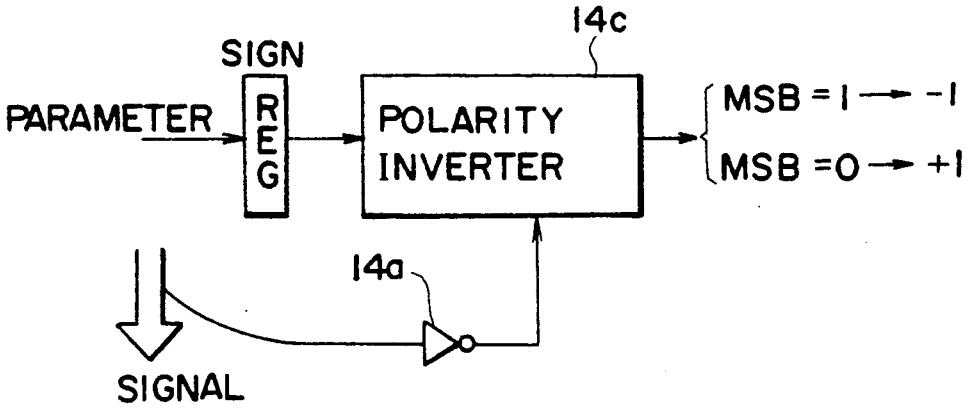

FIGS. 4A to 4C show detailed arrangements of the $\beta$ sign controller 14 shown in FIG. 1.

In FIG. 4A, a positive/negative judgement circuit 14*a* judges the sign of $\beta$, i.e., whether $\beta$ is positive or negative, and a selector 14*b* selects one of $+1$ and $-1$ according to the output from the positive/negative judgement circuit 14*a* and supplies the selected $\beta$ to the multiplier 15.

When an input signal is expressed in a twos complement form, the sign of a signal can be determined on the basis of the MSB (most significant bit) as a sign bit indicating the sign of the signal.

In FIG. 4B, an inverter for inverting the MSB of a signal is used as the positive/negative judgment circuit 14*a*. If a signal is positive, the inverter outputs a judgment output "1"; otherwise, it outputs "0". The selector 14*b* receives feedback constants $+1$ and $-1$ which are set in accordance with a musical tone parameter, selects $-1$ supplied to its A input terminal in response to the judgment output "1", and $+1$ supplied to its B input terminal in response to the judgment output "0", and supplies the selected $\beta$ to the multiplier 15.

FIG. 4C shows an arrangement wherein a polarity inverter 14*c* is used in place of the selector 14*b* shown in FIG. 4B to simply change the polarity according to a positive or negative signal.

Figure 5:
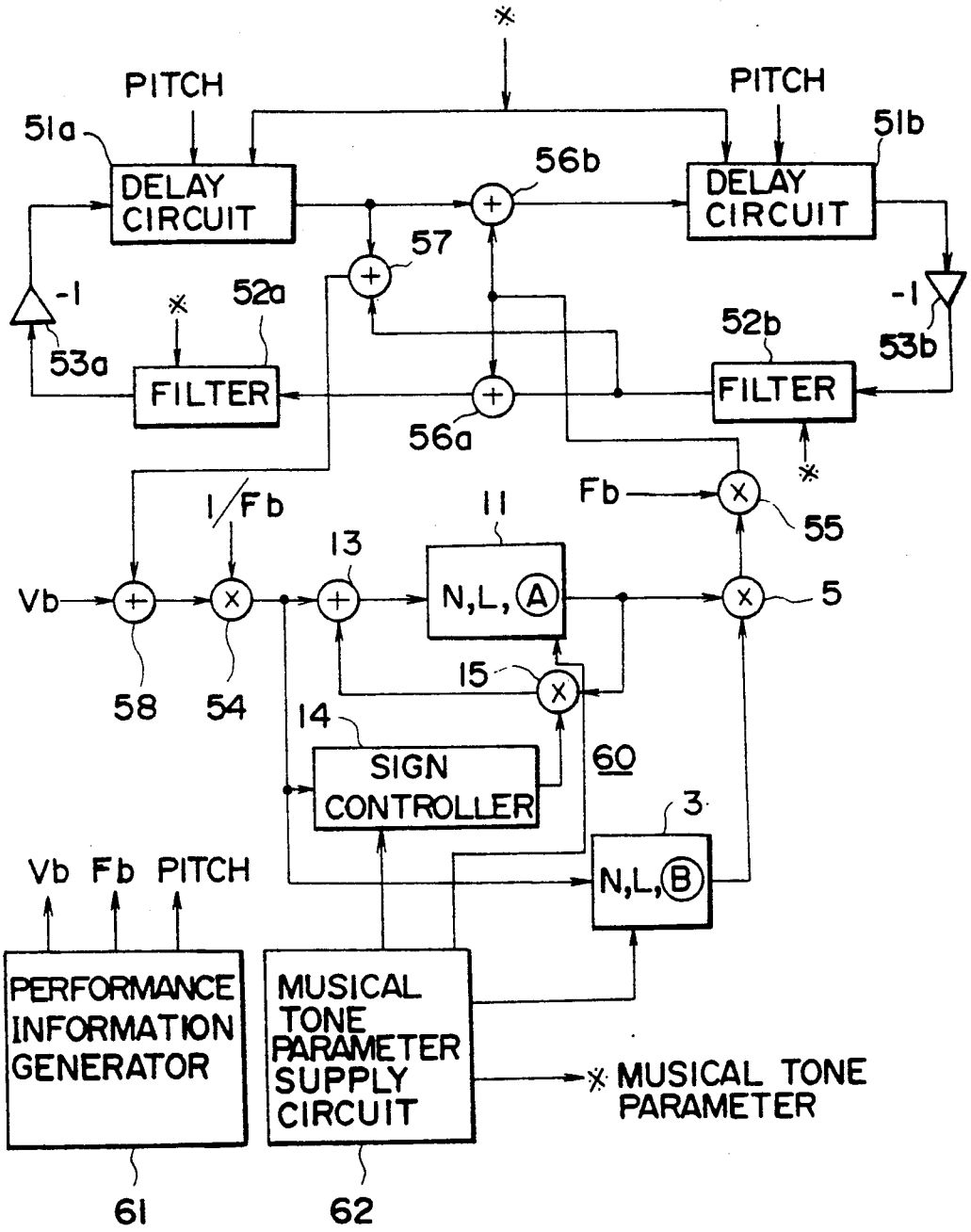
FIG. 5 is a block diagram showing the second embodiment as a musical tone synthesis apparatus utilizing the nonlinear function generation apparatus shown in FIG. 1.

FIG. 5 shows a musical tone synthesis apparatus to which the nonlinear function generation apparatus shown in FIG. 1 is to be applied. The same reference numerals in FIG. 5 denote the same parts as in FIG. 1.

Second Embodiment

The apparatus shown in FIG. 5 synthesizes a performance tone of a bowed instrument such as a violin by digital data arithmetic processing, and comprises delay circuits 51*a* and 51*b*, low-pass filters (LPFs) 52*a* and 52*b*, multipliers 53*a*, 53*b*, 54, and 55, adders 56*a*, 56*b*, 57, and 58, and a nonlinear function generation apparatus 60 as the characteristic feature of the present invention.

A closed loop constituted by the delay circuits 51*a* and 51*b*, the LPFs 52*a* and 52*b*, the multipliers 53*a* and 53*b*, and the adders 56*a* and 56*b* corresponds to a string to be bowed with a bow, and a delay time of the closed loop corresponds to a resonance frequency of the string.

The delay times of the delay circuits 51*a* and 51*b*, and transfer functions of the LPFs 52*a* and 52*b* are controlled on the basis of performance information by a performance information generator 61 and a musical tone parameter supply circuit 62.

Each of the multipliers 53*a* and 53*b* multiplies "$-1$" with an input signal, and outputs a product. Thus, these multipliers are used as phase inverters. Note that these multipliers may be used as attenuators by multiplying a constant having an absolute value less than 1 with an input.

The adders 56*a* and 56*b* correspond to a bowed point, and the closed loop is separated into a first signal path consisting of the delay circuit 51*a*, the LPF 52*a*, and the multiplier 53*a* and a second signal path consisting of the delay circuit 51*b*, the LPF 52*b*, and the multiplier 53*b* to sandwich the adders 56*a* and 56*b* therebetween in correspondence with two sides sandwiching a bowed point of a string.

The nonlinear function generation apparatus is the same as that shown in FIG. 1, and comprises a step function generator 11, an adder 13, a sign controller 14, and a multiplier 15, which constitute a hysteresis function generator, a nonhysteresis function generator 3, and a multiplier 5. Note that a feedback constant $\beta$ is set to be "1", and a feedback circuit 12 is not illustrated as a block since it is constituted by only connection lines.

The nonlinear function generation apparatus 60 receives a signal obtained as follows. That is, a signal obtained by synthesizing outputs from the first and second paths by the adder 57 is added to a signal representing a bow velocity Vb by the adder 58, and the sum signal is then multiplied with a signal representing a reciprocal number 1/Fb of a bow pressure by the multiplier 54, thus obtaining an input signal to the apparatus 60. The apparatus 60 outputs a nonlinear function E having I/O characteristics shown in FIG. 3B in response to each instantaneous level of this input signal.

This nonlinear function output signal is added to the outputs from the second and first signal paths by the adders 56*a* and 56*b*, respectively, and the corresponding sum signals are then inputted to the first and second signal paths.

The apparatus shown in FIG. 5 is a so-called physical model obtained by physically approximating a mechanical vibration system of, e.g., a string of a bowed instrument and a driving system of a bow and the string by an electrical circuit. When approximation precision of these systems is improved, tones of acoustic musical instrument can be faithfully reproduced.

Figure 3B:
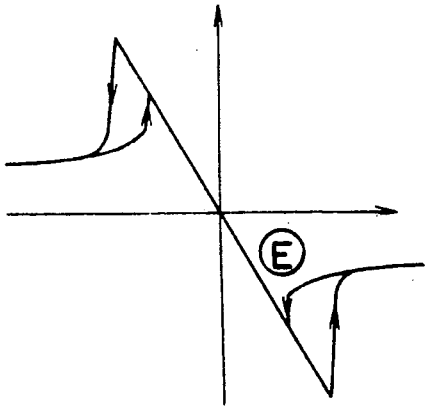

For example, I/O characteristics shown in FIG. 3B represent friction characteristics between a bow and a string, and have nonlinear characteristics and hysteresis characteristics upon transition from a static friction to a dynamic friction. As a bow pressure is increased, the static friction becomes larger. Therefore, the hysteresis characteristics are changed according to a bow pressure Fb. The multipliers 54 and 55 are used to precisely approximate the influence of the bow pressure Fb on the hysteresis characteristics.

In an acoustic instrument, a width of a hysteresis tends to be increased as an increase in bow pressure Fb. If this can be realized in a synthesis algorithm, quality of a synthesized tone can be further improved. Such an effect can be obtained by controlling the feedback constant $\beta$ in the nonlinear function generation apparatus 60 according to the bow pressure Fb. As the value of the constant $\beta$ is increased, the width of the hysteresis is increased. Therefore, control by means of an arithmetic operation or a table look-up operation for increasing the value of the constant $\beta$ as the bow pressure Fb is increased is preferably added.

THIRD EMBODIMENT

Figure 6:
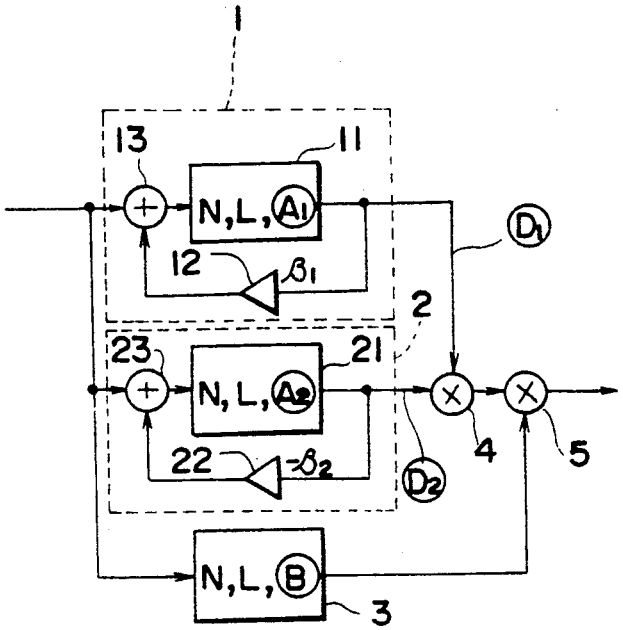
FIG. 6 is a block diagram showing an arrangement of a nonlinear function generation apparatus according to the third embodiment of the present invention.

FIG. 6 shows an arrangement of a nonlinear function generation apparatus according to the third embodiment of the present invention.

Figures 7A, 7B, 7C, 7D:
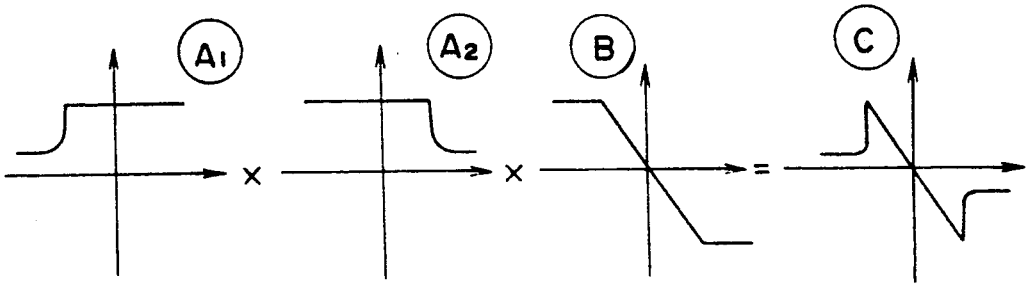
FIGS. 7A to 7D and FIGS. 8A to 8C are graphs showing nonlinear functions for explaining the operation principle of the apparatus shown in FIG. 6.
Figures 8A, 8B, 8C:
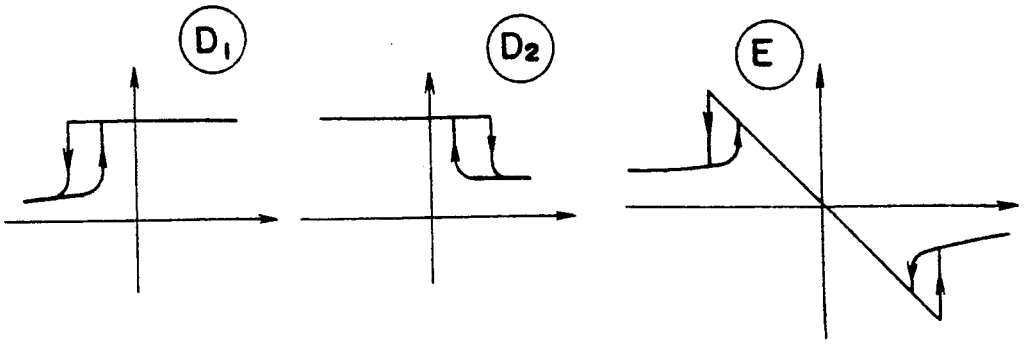

The apparatus shown in FIG. 6 decomposes a nonlinear function C shown in FIG. 7D into a product of nonlinear functions generators 11, 21 and 3 of which input-output characteristic shows nonlinear function $A_1$, $A_2$, and B as shown in FIGS. 7A to 7D, and provides a hysteresis to the nonlinear functions $A_1$ and $A_2$ by a feedback operation to obtain hysteresis functions $D_1$ and $D_2$ shown in FIGS. 8A and 8B. The apparatus then multiplies these functions $D_1$ and $D_2$ with the nonlinear function B shown in FIG. 7C to generate a nonlinear function having a hysteresis, as shown in FIG. 8C. Therefore, the apparatus comprises a first hysteresis function generator 1 for generating the hysteresis function $D_1$, a second hysteresis function generator 2 for generating the hysteresis function $D_2$, a basic characteristic function generator 3 for generating the nonhysteresis basic characteristic function B, a multiplier 4 for multiplying the functions $D_1$ and $D_2$, and a multiplier 5 for multiplying the output from the multiplier 4 and the function C.

The first hysteresis function generator 1 comprises the first basic nonlinear function $A_1$ represented by a stepped curve shown in FIG. 7A, a feedback circuit 12 for feeding back an output from the basic nonlinear function generator 11 to the input side, and an adder 13. The second hysteresis function generator 2 comprises a nonlinear function generator 21, a feedback circuit 22, and an adder 23 like in the first hysteresis function generator 1. In the first hysteresis function generator 1, the basic nonlinear function $A_1$ has a positive inclination, as shown in FIG. 7A. Therefore, if the feedback circuit 12 is provided with a positive feedback constant $\beta(=\beta_1)$, the hysteresis function $D_1$ obtained by providing a hysteresis to the basic nonlinear function $A_1$ by PFB is generated. Similarly, in the second hysteresis function generator 2, since the basic nonlinear function $A_2$ has a negative inclination, as shown in FIG. 7B, the feedback circuit 22 is provided with a negative feedback constant $\beta(=-\beta_2)$ to form a PFB system, so that a hysteresis can be provided to the basic nonlinear function $A_2$.

Note that the feedback constants $\beta$ of the feedback circuits 12 and 22 may have the same or different absolute values $\beta_1$ and $\beta_2$.

FOURTH EMBODIMENT

Figure 9:
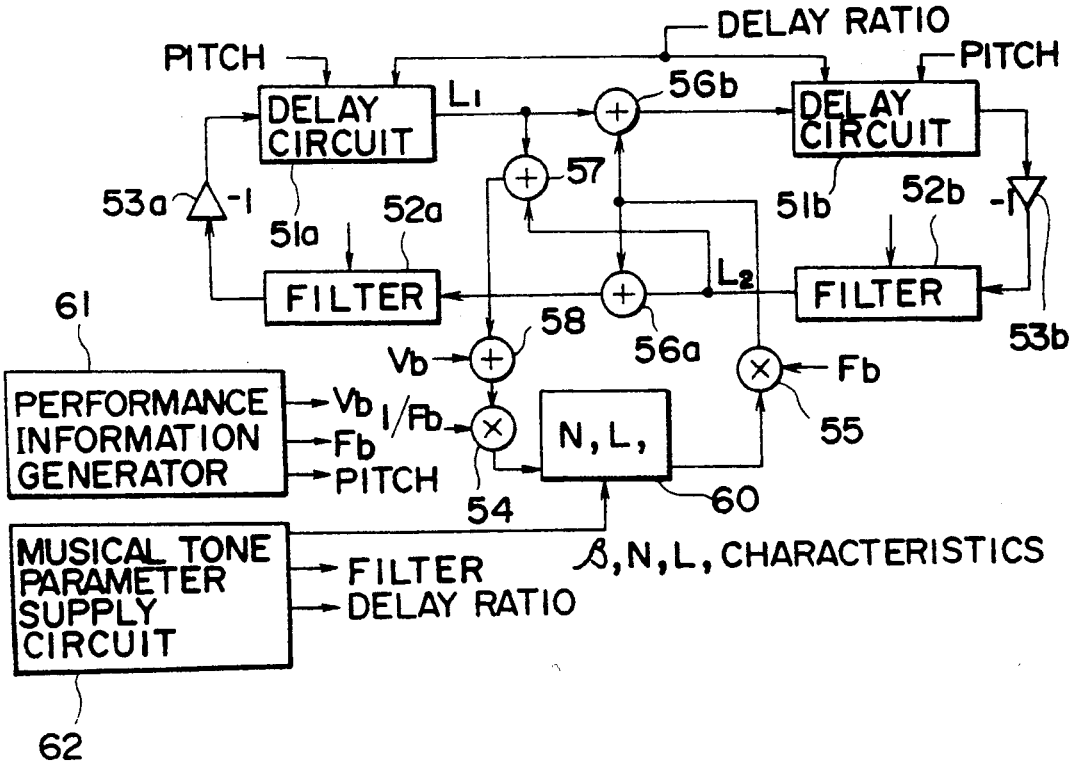
FIG. 9 is a block diagram showing the fourth embodiment as a musical tone synthesis apparatus utilizing the nonlinear function generation apparatus shown in FIG. 6.
Figure 10:
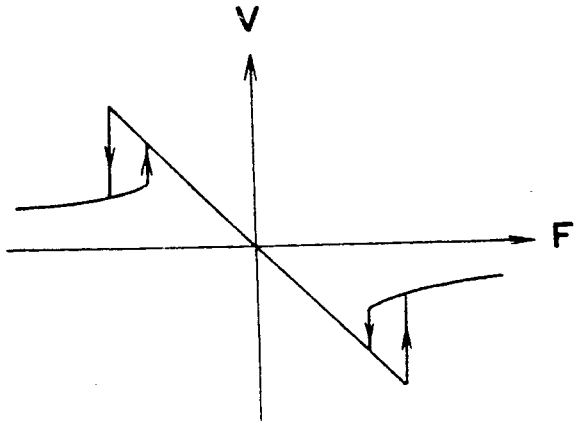
FIG. 10 is a graph showing a nonlinear function required in a bowed string algorithm.
Figure 11:
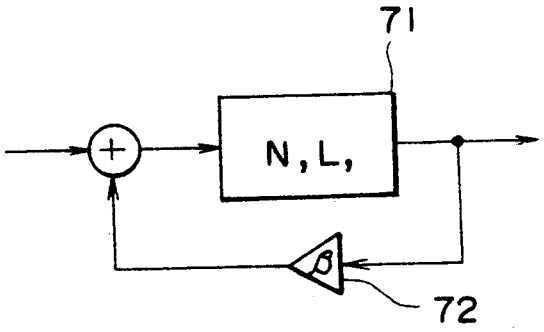
FIG. 11 is a block diagram showing an arrangement of a conventional feedback type nonlinear function generation apparatus.
Figure 12:
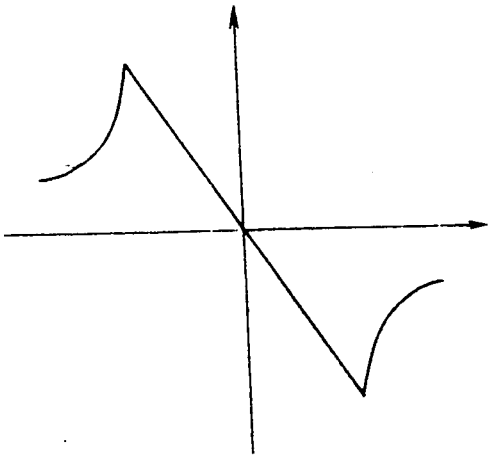
FIG. 12 is a graph showing a nonlinear function stored in a nonlinear function table shown in FIG. 11.

FIG. 9 shows an arrangement of a musical tone synthesis apparatus to which the nonlinear function generation apparatus shown in FIG. 6 is applied.

The apparatus shown in FIG. 9 has substantially the same arrangement as that of the apparatus shown in FIG. 5, except that the nonlinear function generation apparatus 60 of the apparatus shown in FIG. 5 is replaced with that shown in FIG. 6. The same reference numerals in FIG. 9 denote the same parts as in FIG. 5, and a repetitive description will be avoided.

MODIFICATIONS OF EMBODIMENTS

Each of the above-mentioned embodiments can be realized by either a digital or analog technique. When a digital technique is employed, a delay means must be included in a closed loop. For example, in the circuit shown in FIGS. 1, 5, or 6, delay means such as unit delay means must be inserted before or after the feedback circuits 12 and 22, or before or after the nonlinear function generators 11 and 21.

In FIG. 6, the hysteresis function generators 1 and 2 are connected in parallel with each other. However, these generators may be connected in series with each other to obtain the same effect as described above.

In the third embodiment, two hysteresis functions are synthesized. However, the number of hysteresis function is not limited to two, but three or more functions may be synthesized.

In each of the above-mentioned embodiments, a bowed instrument is simulated. However, the present invention may be applied to other musical instruments, such as wind instruments.

Furthermore, when the feedback constant $\beta$ is changed in correspondence with the bow pressure Fb, they need only have a proportional relationship. However, in addition, in order to express and approximate a surface roughness of a bow, a filtered random value may be multiplied with or added to the constant $\beta$.

What is claimed is:

1. A nonlinear function generation apparatus comprising:

hysterisis function generation means for generating a hysterisis function using an input signal as a variable, said hysterisis function generation means including basic nonlinear function generation means for generating a nonhysterisis basic nonlinear function, and feedback means for positively feeding back an output from said basic nonlinear function generation means to an input side of said basic nonlinear function generation means to be combined with the input signal and supplying the combined signal to said basic nonlinear function generation means whereby a hysterisis function is provided;

nonhysterisis function generation means for generating a nonhysterisis function using the input signal as a variable; and synthesis arithmetic means for synthesizing the functions outputted from said hysterisis and nonhysterisis function generation means to provide an overall desired nonlinear function having hysterisis.

2. An apparatus according to claim 1, wherein said hysteresis function generation means comprises a plurality of hysteresis function generation units for generating different unit hysteresis functions using said input signal as a variable, and second synthesis arithmetic means for synthesizing the plurality of unit functions outputted from said hysteresis function generation units.

3. A musical tone synthesis apparatus for synthesizing musical tones comprising:

closed loop means including delay means having a delay length which determines pitch of the musical tones;

nonlinear function generating means having nonlinear characteristics for generating a converted signal based on a performance operation signal and a signal transmitted in the closed loop means as variables, and for supplying the converted signal to the closed loop means, said nonlinear function generating means further including (a) hysterisis function generation means for generating and outputting a hysterisis function using an input signal as a variable, (b) nonhysterisis function generation means for generating and outputting a nonhysterisis function using the input signal as a variable and (c) synthesis arithmetic means for receiving and synthesizing the hysterisis and nonhysterisis functions outputted from said hysterisis and nonhysterisis function generation means, and for outputting a synthesized function having hysterisis as said converted signal.

4. An apparatus according to claim 3, wherein said hysteresis function generation means comprises basic nonlinear function generation means for generating a nonhysteresis basic nonlinear function, and feedback means for positively feeding back an output from said basic nonlinear function generation means to an input side of said basic nonlinear function generation means to be synthesized with the input signal and supplying the synthesized signal to said basic nonlinear function generation means as a variable.

5. An apparatus according to claim 4, wherein said basic nonlinear function is a step function.

6. An apparatus according to claim 3, wherein said hysteresis function generation means comprises a plurality of hysteresis function generation units for generating different unit hysteresis functions using an input signal as a variable, and second synthesis arithmetic means for synthesizing the plurality of unit functions outputted from said hysteresis function generation units.

* * * * *